US011313537B2

(12) United States Patent
Nanninga et al.

(10) Patent No.: US 11,313,537 B2
(45) Date of Patent: Apr. 26, 2022

(54) LIGHTING FIXTURE WITH REVERSIBLE SHROUD

(71) Applicant: The Toro Company, Bloomington, MN (US)

(72) Inventors: Peter Nanninga, Bloomington, MN (US); Burnett Jones, Bloomington, MN (US); Eden Allen, Bloomington, MN (US); Jorge Rivera, Bloomington, MN (US); Hyok Lee, Bloomington, MN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 17/219,168

(22) Filed: Mar. 31, 2021

(65) Prior Publication Data

US 2021/0310638 A1 Oct. 7, 2021

Related U.S. Application Data

(60) Provisional application No. 63/004,772, filed on Apr. 3, 2020.

(51) Int. Cl.

| | |
|---|---|
| ***F21V 15/01*** | (2006.01) |
| ***F21V 15/015*** | (2006.01) |
| ***F21V 21/30*** | (2006.01) |
| ***F21V 21/26*** | (2006.01) |
| *F21V 1/16* | (2018.01) |

(52) U.S. Cl.

CPC ..... *F21V 15/012* (2013.01); *F21V 15/015* (2013.01); *F21V 21/26* (2013.01); *F21V 21/30* (2013.01); *F21V 1/16* (2013.01)

(58) Field of Classification Search

CPC ..... F21V 1/10; F21V 1/16; F21V 1/146

See application file for complete search history.

(56) References Cited

U.S. PATENT DOCUMENTS

| | | | | | |
|---|---|---|---|---|---|
| 3,270,192 | A * | 8/1966 | Watson | F21V 13/02 | 362/293 |
| 5,061,055 | A * | 10/1991 | Dube | G02B 7/182 | 359/862 |
| 5,599,091 | A * | 2/1997 | Kira | F21V 21/30 | 362/269 |
| 6,612,720 | B1 * | 9/2003 | Beadle | F21V 17/02 | 362/287 |
| 7,494,252 | B1 * | 2/2009 | Thornton | F21V 29/15 | 362/154 |
| 9,115,884 | B2 * | 8/2015 | White | F21S 13/12 | |
| 2004/0095754 | A1 * | 5/2004 | Hsu | A61L 9/03 | 362/161 |
| 2007/0183151 | A1 * | 8/2007 | Joseph | F21V 21/35 | 362/232 |
| 2008/0186717 | A1 * | 8/2008 | Ruberg | F21V 29/15 | 362/365 |

(Continued)

*Primary Examiner* — Zheng Song

(74) *Attorney, Agent, or Firm* — Inskeep IP Group, Inc.

(57) ABSTRACT

Disclosed is a lighting fixture with a shroud that can be removed and repositioned on the housing of the lighting fixture. The shroud may have a first end with a first shape and a second end with a second shape that is different than the first shape. The user may reorient the shroud to face one of the two ends away from and at different elevations relative to the lens to provide different shapes to the light emitted from the fixture.

20 Claims, 11 Drawing Sheets

(56) References Cited

U.S. PATENT DOCUMENTS

| | | | | |
|---|---|---|---|---|
| 2010/0079075 | A1* | 4/2010 | Son | F21V 29/763 315/152 |
| 2013/0208489 | A1* | 8/2013 | Schmuckle | F21K 9/20 362/363 |
| 2014/0119022 | A1* | 5/2014 | Beausoleil | F21V 23/006 362/294 |
| 2018/0100638 | A1* | 4/2018 | Lee | F21S 8/032 |
| 2021/0108787 | A1* | 4/2021 | Erdener | F21S 8/081 |
| 2021/0180779 | A1* | 6/2021 | Erdener | F21V 19/02 |

* cited by examiner

LIGHTING FIXTURE WITH REVERSIBLE SHROUD

RELATED APPLICATIONS

This application claims benefit of and priority to U.S. Provisional Application Ser. No. 63/004,772 filed Apr. 3, 2021 entitled Lighting Fixture With Reversible Shroud, which is hereby incorporated herein by reference in its entirety.

BACKGROUND OF THE INVENTION

Outdoor lighting can be used to illuminate various spaces outside of a home, business, or other building. Typically, low voltage lights are used for such lighting and may require that the lights to be wired to a transformer that transforms the higher voltage AC power (e.g., 120 VAC) to low voltage AC power (e.g., 12-22 VAC).

The lighting typically comprises an LED or halogen bulb that is mounted within a decorative lighting fixture. Fixtures typically include a housing in which the bulb is located, a lens through which the bulb shines, and a mounting base that allows the housing to be angled to a desired position. These fixtures come in a variety of different shapes and sizes, as seen in U.S. Pat. No. 10,393,352, which is hereby incorporated by reference in its entirety.

Some fixtures also include a shroud or a structure that extends beyond the lens of the lighting fixture to help shape the light that is emitted. Typically, these shrouds are connected or integral with the structure of the fixture such that they only have a single position and orientation. Hence, the user is unable to adjust or customize the shape of the light from these lighting fixtures.

SUMMARY OF THE INVENTION

The present invention is directed to a lighting fixture with a shroud that can be removed and repositioned on the housing of the lighting fixture. The shroud may have a first end with a first shape and a second end with a second shape that is different than the first shape. For example, a first end of the shroud may have an edge that is non-perpendicular relative to longitudinal side walls of the shroud (e.g., within a range of 10 to 80 degrees), and a second end of the shroud may have an edge that is perpendicular relative to the longitudinal side walls of the shroud (e.g., about 90 degrees). In another example, both ends of the shroud may be non-perpendicular but have different angles relative to the walls of the shroud. The user may reorient the shroud to face one of the two ends upward and at different elevations relative to the lens to provide different shapes to the light emitted from the fixture.

The lighting fixture also includes a retention mechanism to retain the shroud in various positioned on the fixture's housing. For example, the housing or shroud may include an elastomeric ring or band that provides a frictional fit to the shroud on the housing. In another example, the shroud and housing may include detent features that help engage the shroud at different positions.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
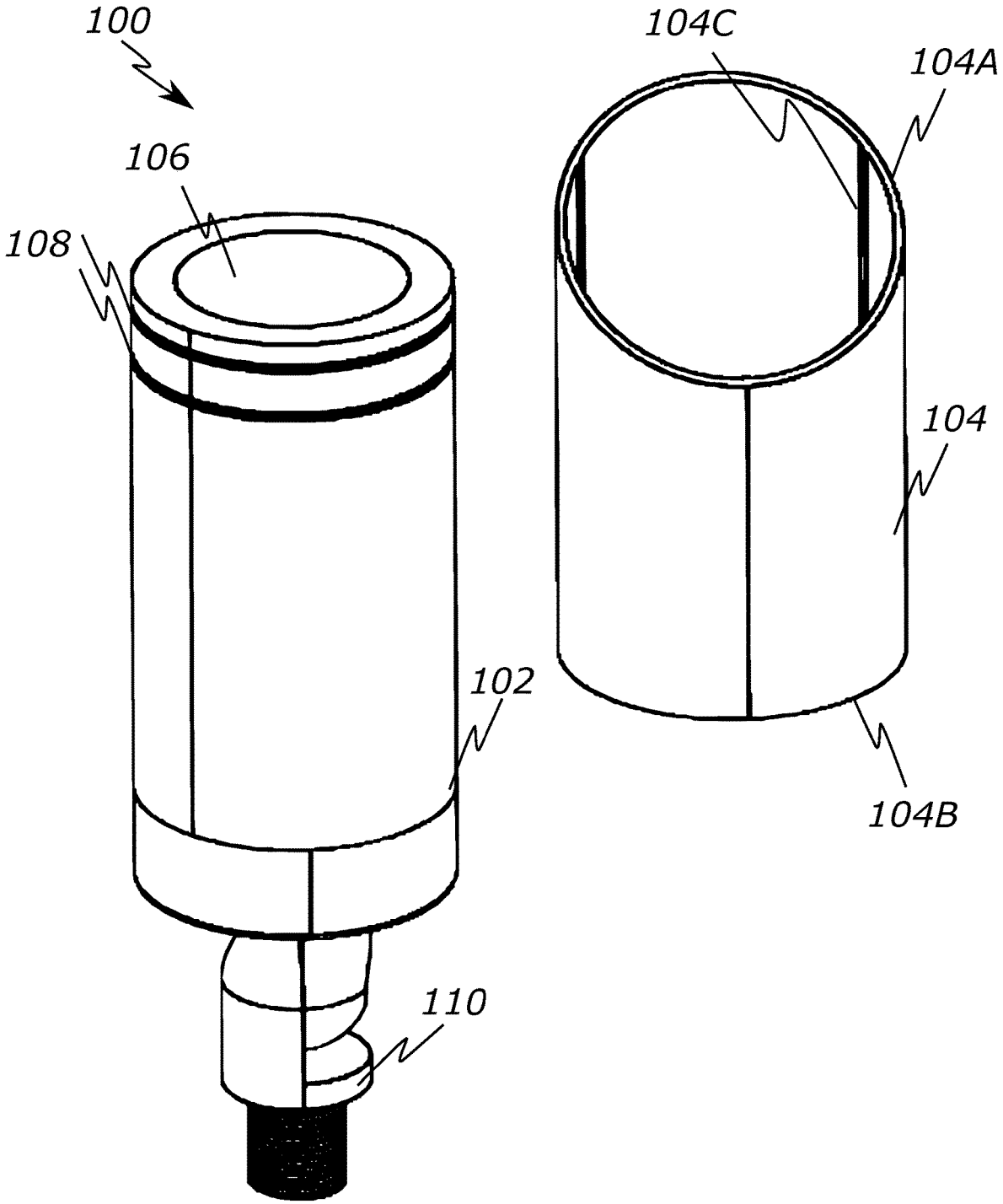
FIG. 1 is a perspective of a light assembly with its shroud removed.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The present invention is directed to a lighting fixture that has a removable shroud that can be placed on the body of the lighting fixtures in two different orientations and at different distances from the top of the lighting fixture. Each end preferably has an edge with a different shape (e.g., a flat edge or an angled edge) which allows the user to adjust both the look of the fixture and the shape of the light emanating from the fixture.

Turning to FIG. 1, a lighting fixture 100 is illustrated with a removable shroud 104. In this embodiment, the lighting fixture 100 has a cylindrical housing 102 that encloses a bulb (e.g., LED bulb) and its associated electrical wiring. The bulb is positioned to shine light through the lens 106 at the top of the housing 102. The bottom of the housing 102 is connected via a pivoting joint to a base 110, which allows the angle of the housing 102 to be adjusted relative to the base 110.

In the present embodiment, the shroud 104 has a cylindrical shape with an internal diameter that is slightly larger than the outer diameter of the housing 102 (e.g., 0.1 cm to 2 cm larger). This sizing allows the shroud 104 to slide over the housing 102. The shroud 104 preferably has ends or edges with two different angles or shapes relative to the passage through the shroud 104 (i.e., relative to an axis extending through the passage and both openings of the shroud 104). For example, an angled end 104A has an edge that forms a non-perpendicular angle relative to the walls or axis of the shroud 104 (e.g., between about 10 and 80 degrees or about 45 degrees relative to the axis or walls of the shroud 104). A perpendicular end 104B has an edge that forms a perpendicular angle relative to the walls of the shroud 104 (e.g., about 90 degrees relative to the axis or walls of the shroud 104).

Figure 2:
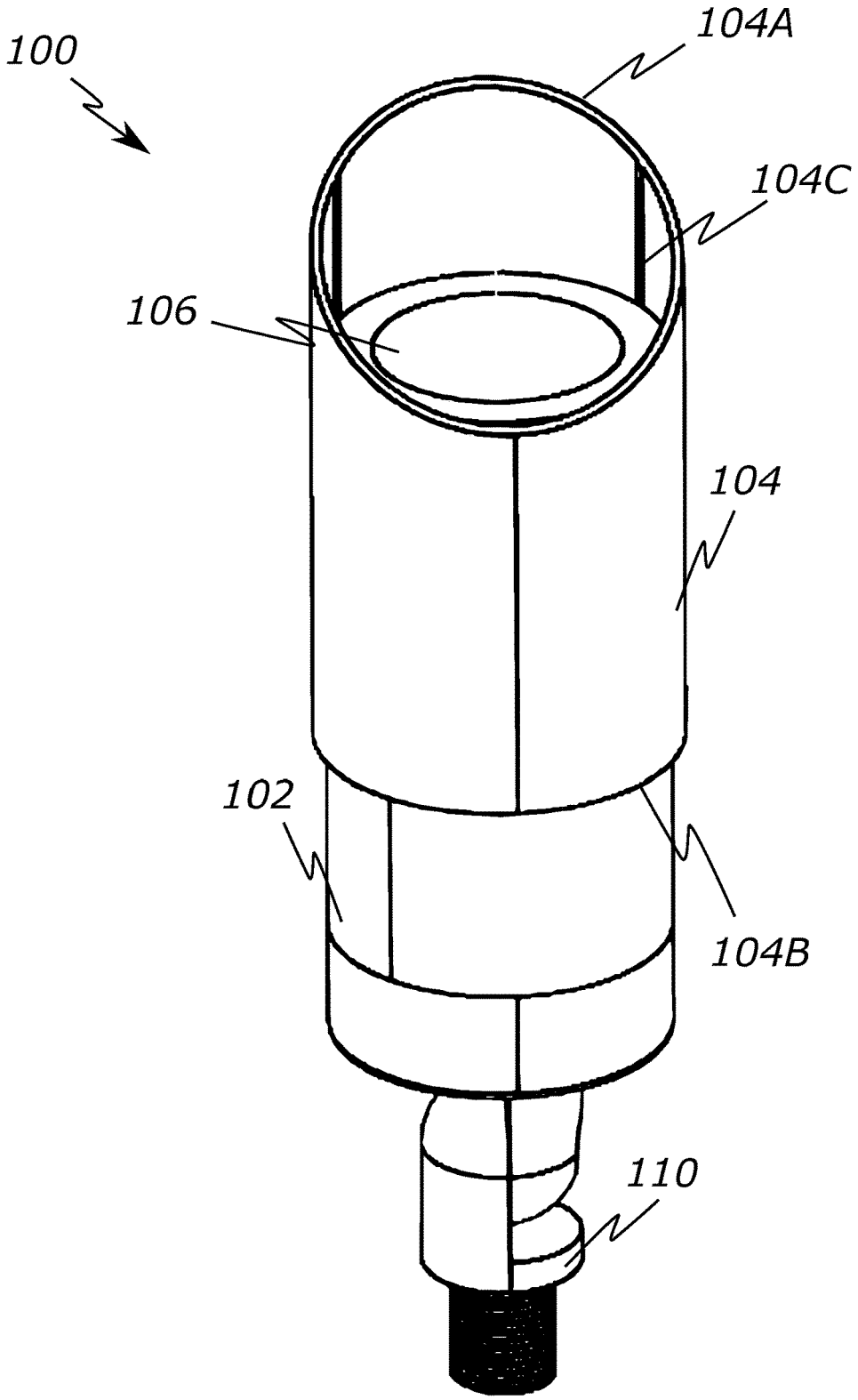
FIG. 2 is a perspective view of a light assembly with its shroud connected.

FIG. 2 illustrates a first orientation that the shroud 104 can be placed on the housing 102. Specifically, the non-perpendicular, angled end 104A is positioned upward, away from the housing 102 while the perpendicular end 104B is positioned downward, around the housing 102. The lowest portion of the angled end 104A is positioned near a top surface of the housing 102, however, the shroud 104 can be moved to various positions higher and lower than that shown in the figure.

Figure 3:
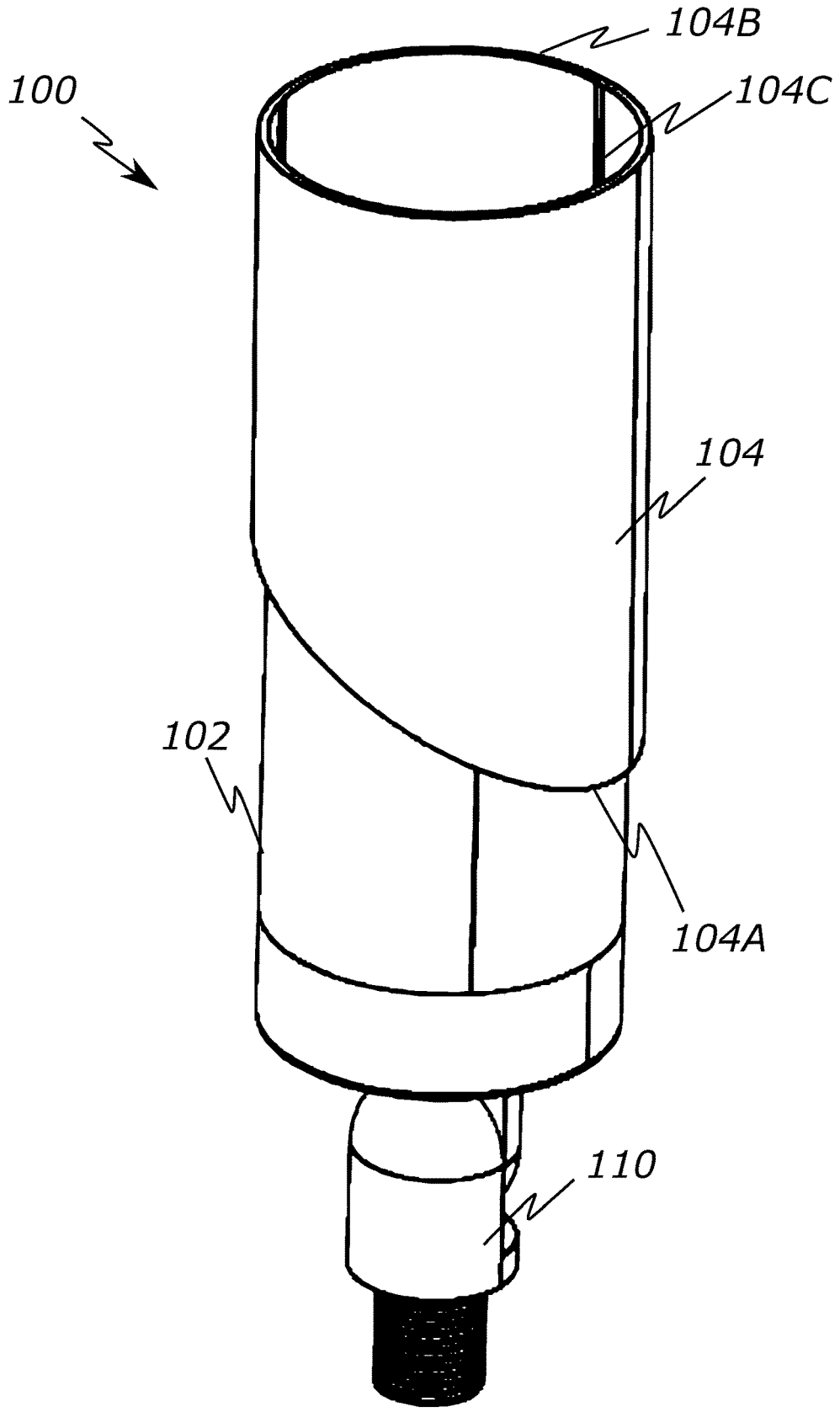
FIG. 3 is a perspective view of a light assembly with its shroud connected.
Figure 4:
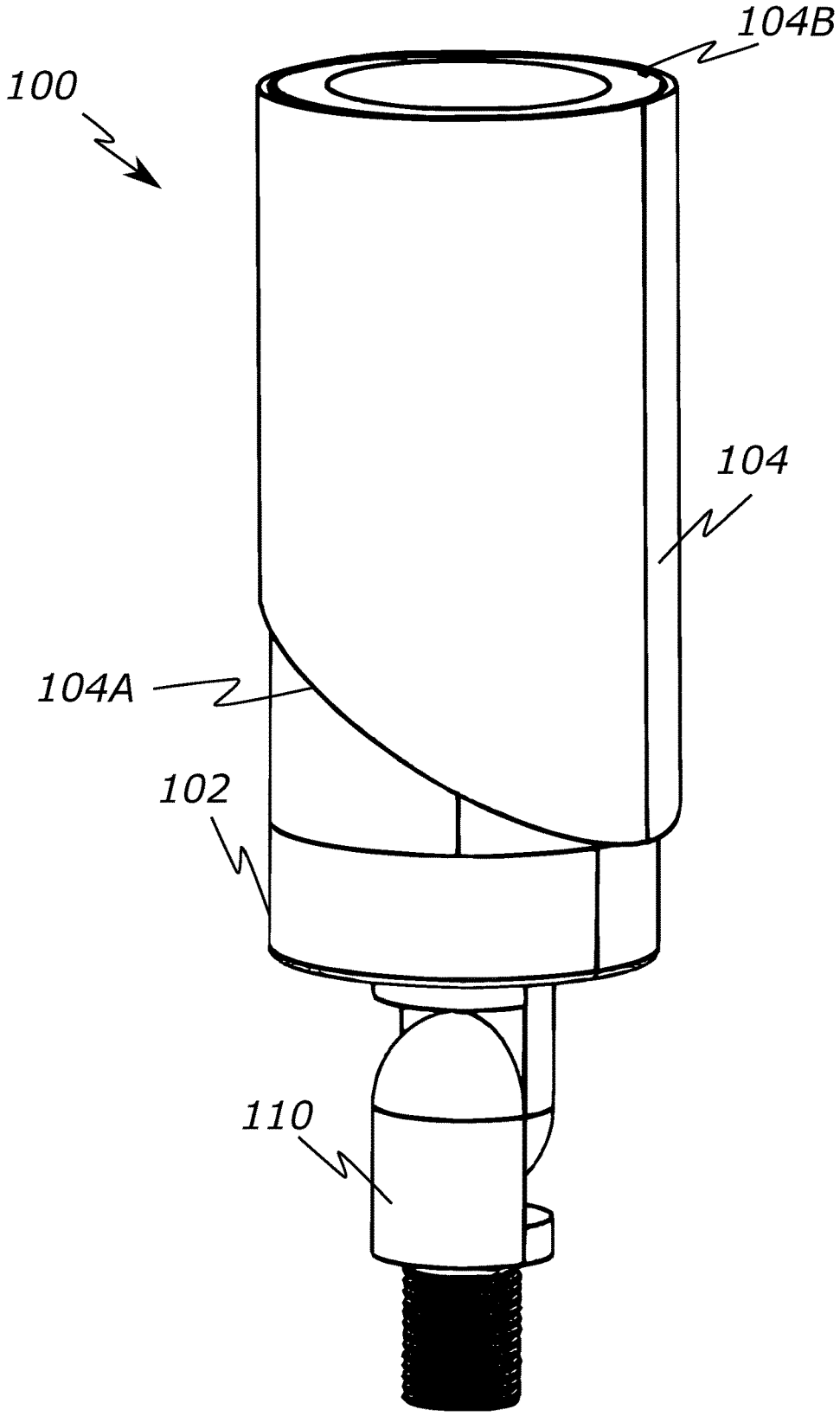
FIG. 4 is a perspective view of a light assembly with its shroud connected.

FIG. 3 illustrates a second orientation of the shroud 104 on the housing 102. In this orientation, the perpendicular end 104B is positioned upward, away from the housing 102 while the angled end 104A is positioned downward, around the housing 102. In this figure, the perpendicular end 104A is elevated above the top of the housing 102. However, the perpendicular end 104B of the shroud 104 can also be positioned at a uniform elevation relative to the top of the housing 102, as seen in FIG. 4, for storage purposes without shaping the light emitted from the lens 106.

Figure 5:
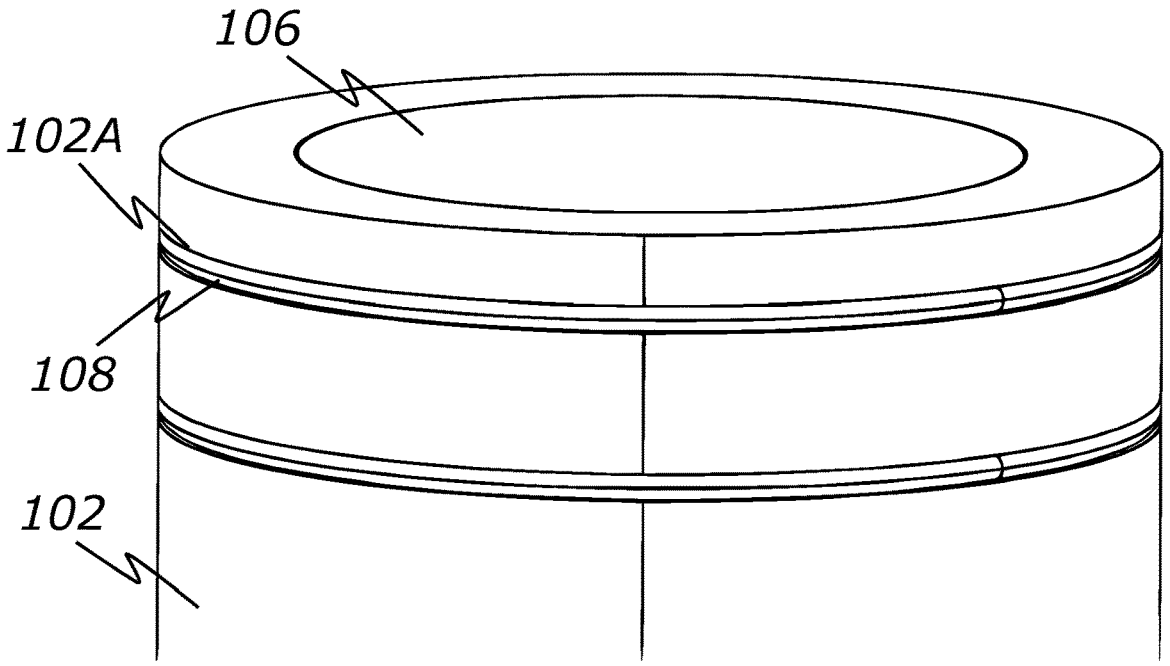
FIG. 5 is a perspective view of a top portion of a light assembly.
Figure 6:
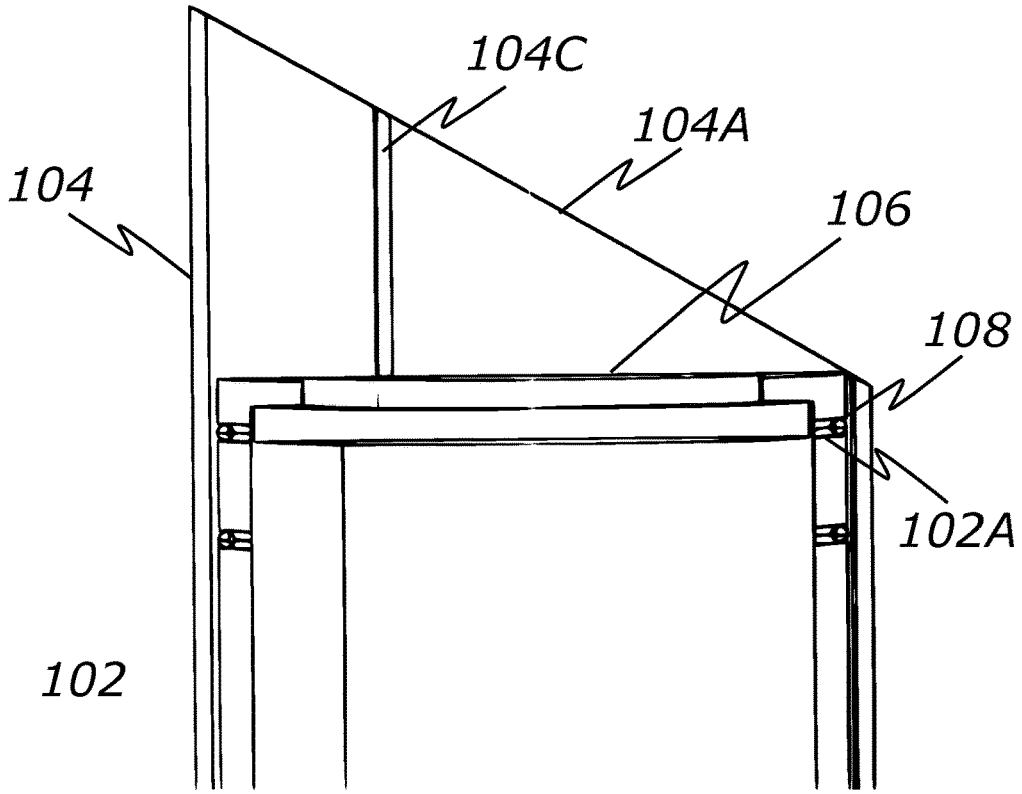
FIG. 6 is a cross sectional view of a light assembly.

The lighting fixture 100 preferably includes a mechanism to help retain the shroud 104 in one or more positions relative to the housing 102. FIG. 5 and the cross-sectional view of FIG. 6 illustrate one mechanism comprising an upper and lower circumferential groove 102A around the housing 102 and an elastomeric or compressible band 108 or O-ring positioned in each of the grooves 102A. The grooves 102A and the band 108 are sized such that the band 108 is positioned slightly radially beyond the diameter of the housing 102 (i.e., the band 108 has a position with a slightly larger diameter than the housing 102, such as 0.1 cm to 1 cm). In this respect, the band 108 can compress when the shroud 104 is placed over it and can provide a sufficient amount of friction to maintain the shroud's position on the housing 102. The band 108 can be composed of silicone, rubber, or a flexible polymer. While two bands 108 and two grooves 102A are disclosed, other numbers are also possible, such as 1, 3, 4, 5, and 6 bands/grooves.

Figure 16A:
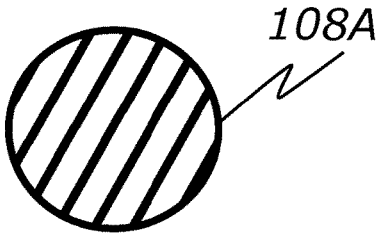
FIGS. 16A and 16B are cross sectional views of O-ring shapes.
Figure 16B:
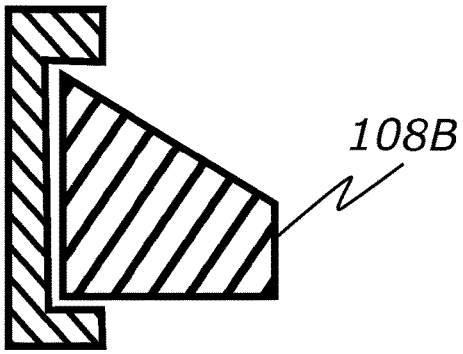

The O-ring 108 may also have one of several different cross-sectional shape. For example, the O-ring 108 may have a circular cross-sectional shape 108A (FIG. 16A) or a square/rectangular cross-sectional shape. In another example, the O-ring 108 may have a chamfer or downwardly and outwardly angled surface (i.e., it increases in width downward, away from the top surface of the light housing 102) to allow the shroud 104 to more easily be moved downward over the O-ring 108. For example, the O-ring 108B (FIG. 16B) may have a generally square/rectangular lower cross-sectional shape with a downwardly angled triangular upper cross-sectional shape.

Figure 7:
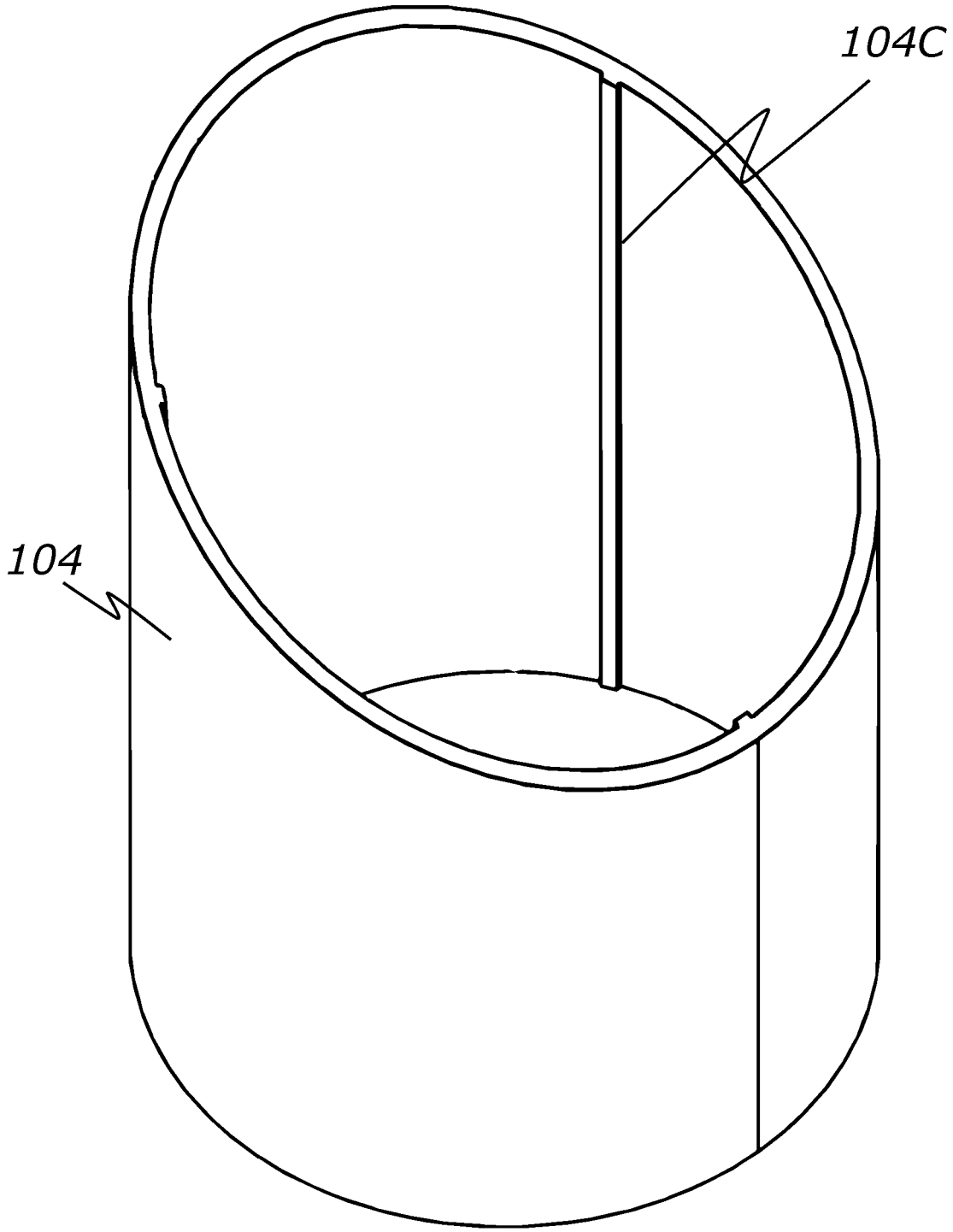
FIG. 7 is a perspective view of a shroud for a light assembly.
Figure 8:
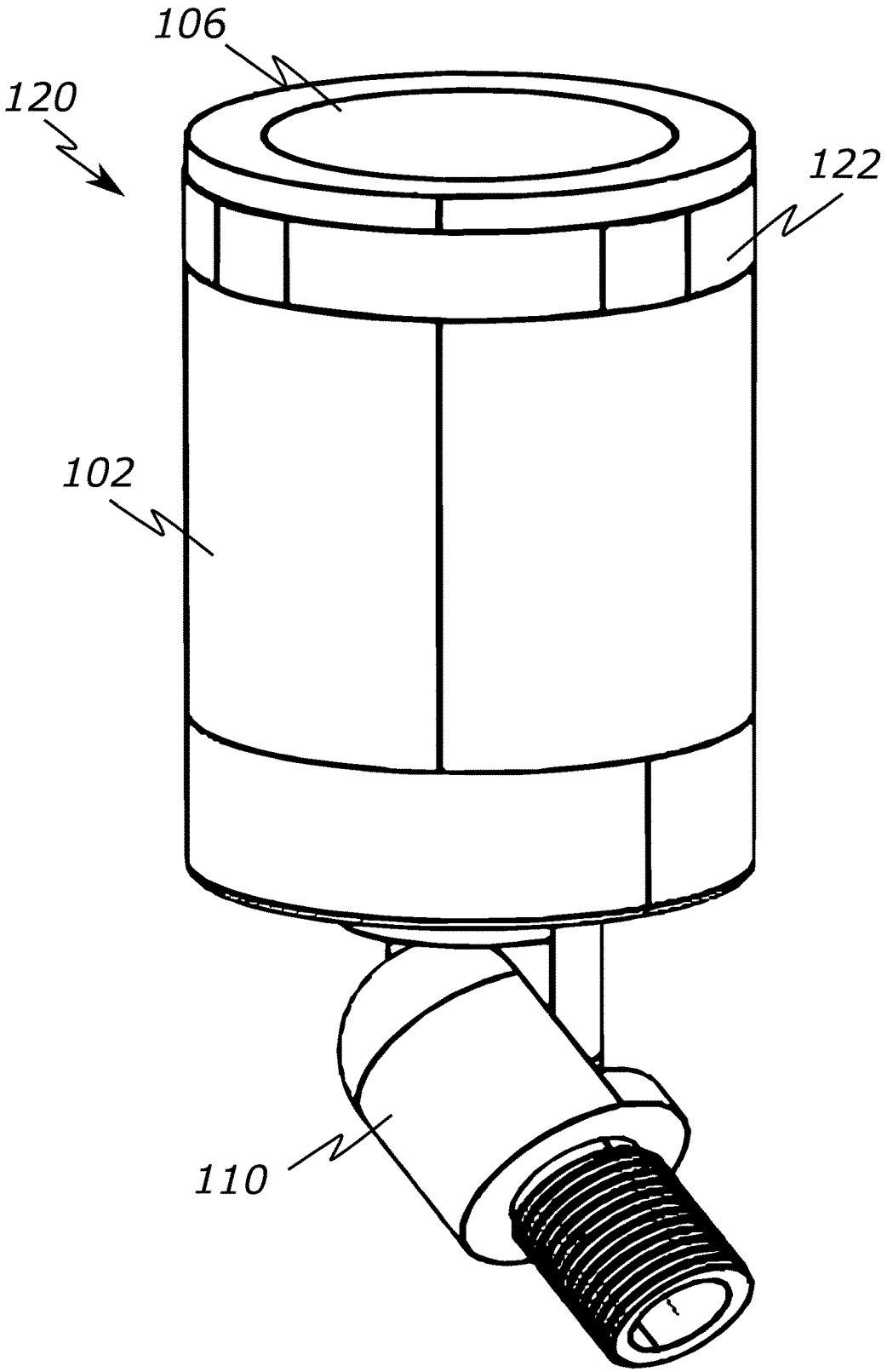
FIG. 8 is a perspective view of a light assembly.
Figure 9:
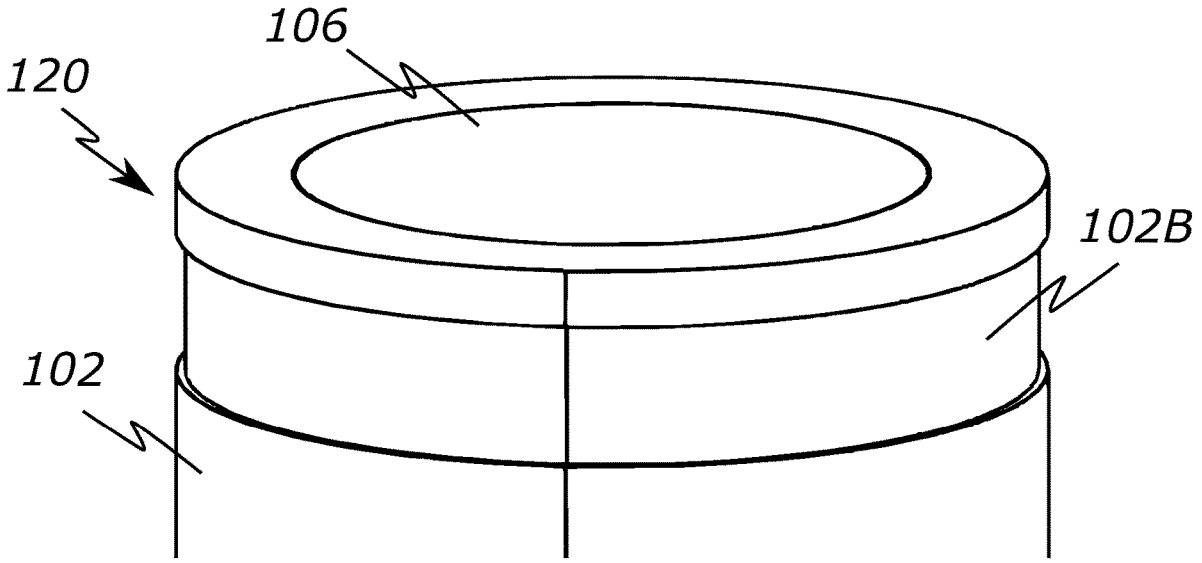
FIG. 9 is a perspective view of a light assembly.
Figure 10:
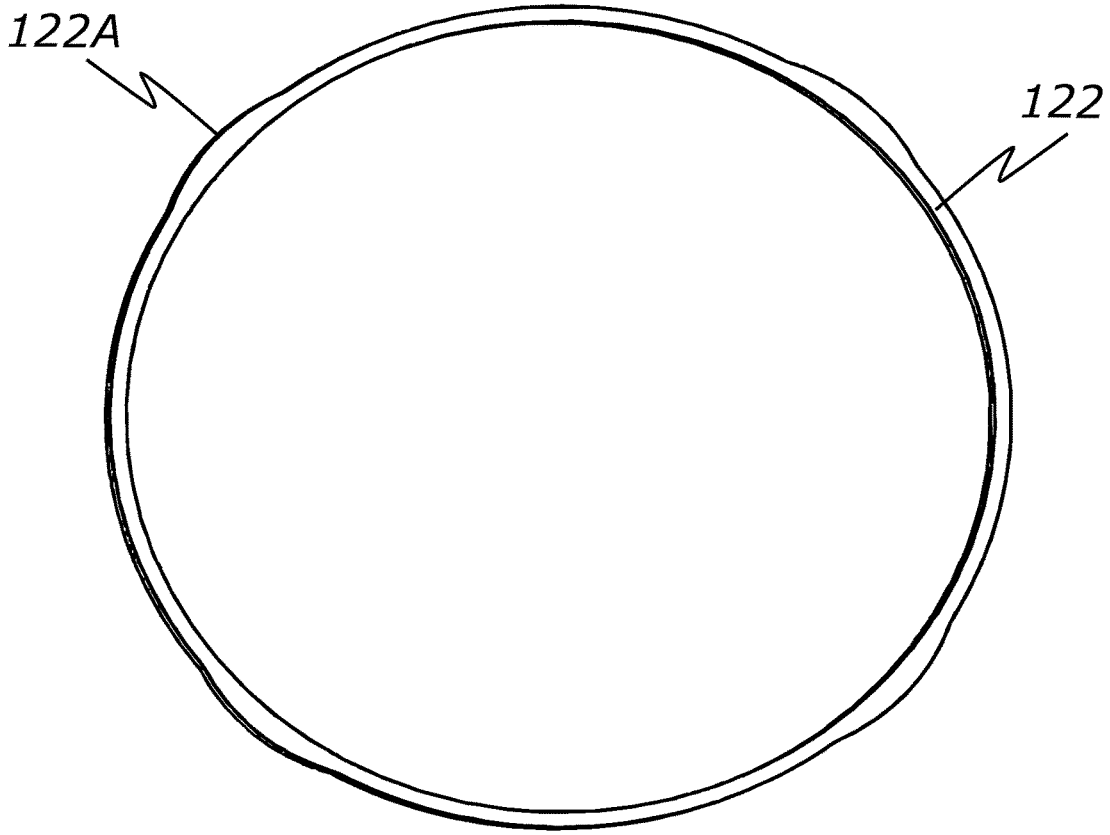
FIG. 10 is top view of a band configured for placement around a light assembly.
Figure 11:
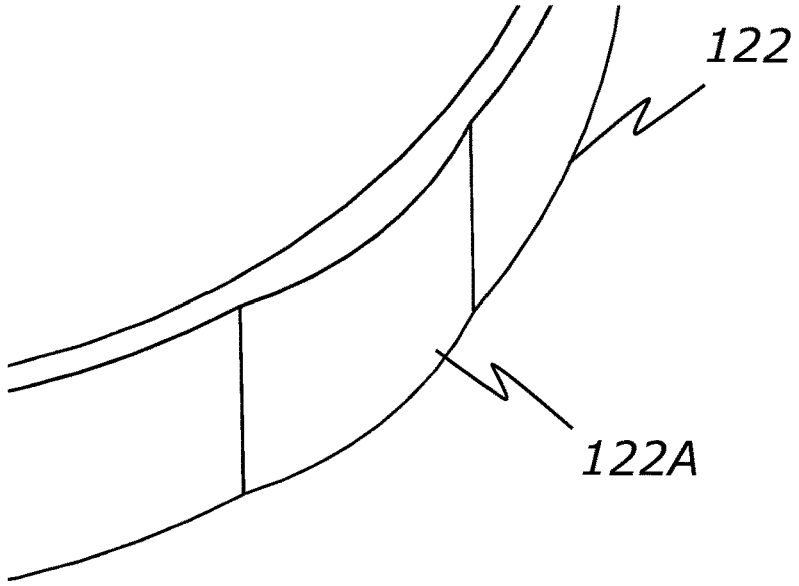
FIG. 11 is a magnified view of the band of FIG. 10.
Figure 12:
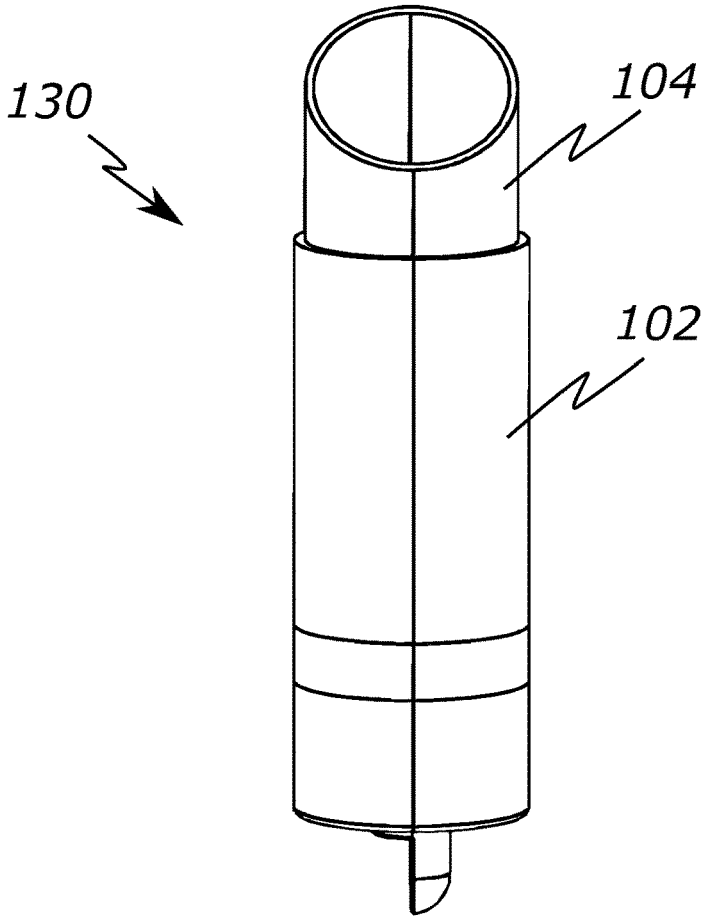
FIG. 12 is a side view of a light assembly.
Figure 13:
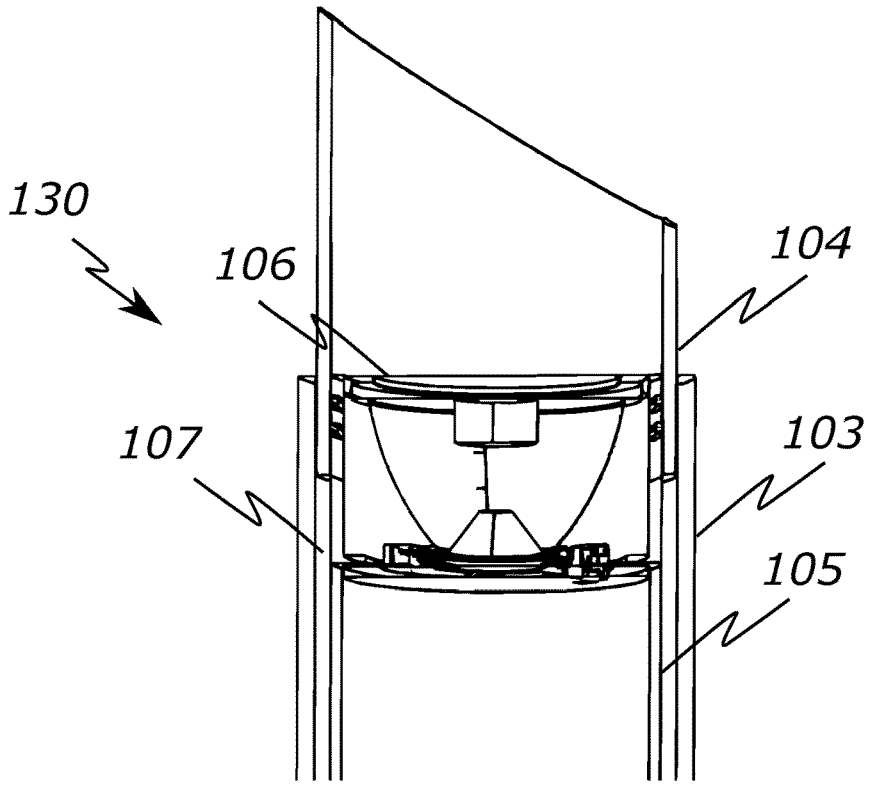
FIG. 13 is a cross sectional view of a light assembly.
Figure 14:
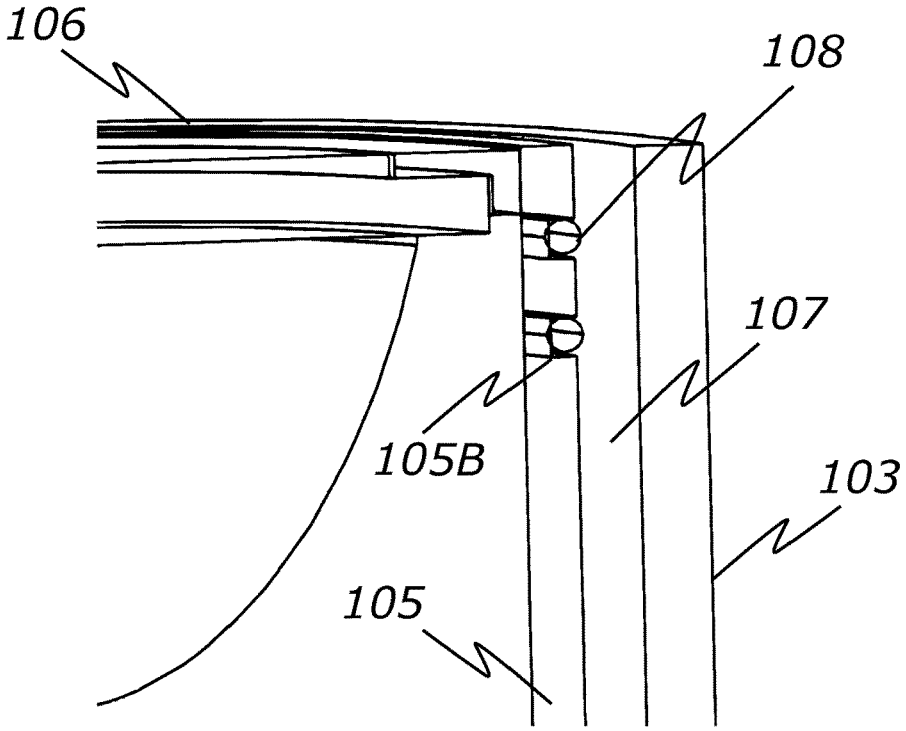
FIG. 14 is a cross sectional view of a light assembly.
Figure 15:
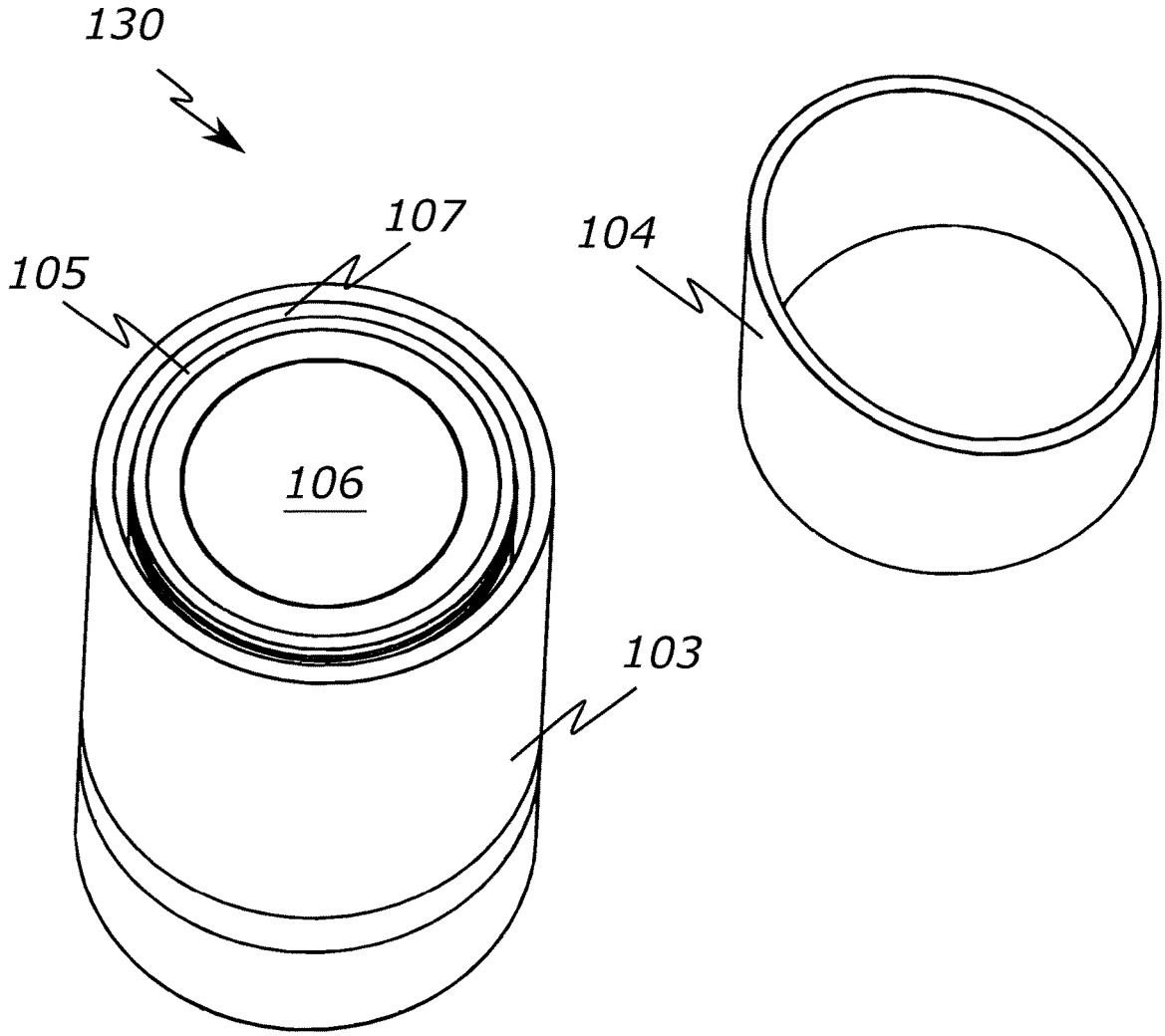
FIG. 15 is a top view of a light assembly.

Additionally, the shroud 104 may include a plurality of longitudinal ribs 104C or raised surfaces on the interior of the shroud 104, as seen in FIG. 7. These ribs may 104C engage with the bands to create additional friction to maintain the position of the shroud 104. The ribs 104C can be integrally composed of the same material as the shroud 104 or can be a different elastomeric material fixed to the shroud 104. In addition to creating friction, the longitudinal ribs 104C maintain small gaps on each side between the walls of the shroud 104 and the housing 102. Since the lighting fixture 100 may be configured to aim upwards, the shroud 104 may collect water from rain. The small gaps between the ribs 104C allow any collected water to drain out along the sides of the housing 102. The shroud 104 may have 1, 2, 3, 4, 5, 6, 7, 8, or more ribs 104C. Additionally, while the top of the housing 102 and lens 106 is depicted as being relatively flat, these surfaces can also be curved or angled to direct water to the edges of the housing 102 and down the sides between the housing 102 and the should 104.

Other retaining mechanism are also possible instead of or in addition to the O-ring/bands 108. For example, the groove and band may instead be located on the inner passage of the shroud 104.

In another example, the housing 102 and shroud 104 may include detent structures that help engage the shroud 104 in specific positions on the housing 102. In one embodiment, this may include one or more raised surfaces on the inner surface of the shroud 104 that are sized and configured to engage with indented surfaces along the length of the housing 102. Hence, as the shroud 104 is moved vertically relative to the housing 102, the raised surfaces engage one or more of the indented surfaces at various locations, providing additional locking or engagement force for the shroud 104.

FIGS. 8-11 illustrate an alternate embodiment of a lighting fixture 120 that is generally similar to the previously described fixture 100, except that it includes a relatively wider band or gasket 122 to frictionally engage the shroud 104 instead of the dual O-rings/bands 108. The gasket 122 is composed of a compressible or elastomeric material, such as silicone or other flexible polymer material and is positioned within a radial groove or gap 1026 near a top of the housing 102. In one embodiment the gasket has a width of between about 1 to 3 inches. While the O-rings/bands 108 are shown to have a relatively uniform thickness, the gasket 122 includes several "bumps" or raised surfaces 122A (e.g., wave-like shapes, rounded ridges, or vertical grooves). These raised surfaces 122A help engage the inner surface of the shroud 104 while also helping to create a gap between the shroud 104 and the outside of the housing 102 to allow for drainage of accumulated water. Note, these curved, raised surfaces 122A may also be included on the O-rings/bands 108 of the prior embodiments.

While the shroud 104 can be configured to engage an outer surface of the housing 102, as previously described, the lighting fixture can also be configured to accept the shroud within its body. For example, FIGS. 12-15 illustrate a lighting fixture 130 having an inner housing wall 105 and an outer housing wall 103 that is spaced apart from the inner housing wall 105 to create a gap 107. The shroud 104 is sized to pass into this gap 107, allowing the user to remove and replace the shroud 104 as desired while keeping the lower portion of the shroud 104 hidden.

The fixture 130 also includes a retention mechanism for the shroud 104, such as the O-rings/bands 108 located in grooves 105A. However, other retention mechanisms discussed in this specification are also possible. Since two walls 103 and 105 are present, the engagement mechanism (e.g., O-rings) can be located on either of the walls or both walls.

While the lighting fixture is shown as a cylindrical shape, other shapes are also possible. For example, the fixture may have a rectangular shape, a conical shape, or a parabolic shape. Additionally, the lighting fixture may have a variety of different dimensions, such as a cross sectional shape of a triangle, square, rectangle, pentagon, or other multisided shape, with a similar shape of the shroud to accommodate such shapes.

It should be noted that in previously known designs, the shroud is integrated with the housing and lens. Hence, most previously known designs rely on a gasket to engaged with portions of the shroud/housing to seal the internal compartment where the light bulb and wiring is located. The designs of the present specification include a separate seal between the housing and the lens which allows the shroud to be removed without breaching the seal around the lens. Additionally, the gaps created between the shroud and housing are not necessarily present in the previously known designs which may prevent them from properly draining water collected in the shroud.

While the shrouds of the present specification are shown as having a generally smooth interior surface (with the exception of the ribs), it should be understood that other design features can be included. For example, the interior surface may include larger ribs, fins, baffles, or similar features to help shape the light emitted through the shroud.

It should be understood that any of the ribs, O-rings, gaskets, or other retention features can be located on either the outer housing of the fixture or on the internal surface of the shroud. Additionally, any combination of the retention features described herein can be used together with each other.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A light fixture for outdoor installation, comprising:

a light housing having an elongated shape;

a lens located at a top of the light housing and configured to allow a light within the light housing to shine therethrough;

a removable shroud having a wall forming a passage with two openings therethrough; the shroud having a first end forming a first angle relative an axis extending through the passage and two openings, and the shroud having a second end forming a second angle relative to the axis; wherein the first angle is different than the second angle; and a first elastomeric band disposed around an outside of the light housing; wherein the first elastomeric band has 1) a completely uniform inner surface configured to uniformly engage the outside of the light housing, and 2) an outer surface having a plurality of vertically-extending raised surfaces projecting radially outward, away from the light housing to create areas of increased and decreased thicknesses alternating circumferentially around the first elastomeric band;

wherein the shroud is configured to be positioned such that either the first end or the second end is positioned beyond the top of the light housing.

2. The light fixture of claim 1, wherein the first angle is perpendicular and the second angle is non-perpendicular.

3. The light fixture of claim 2, wherein the second angle about 45 degrees relative to the axis.

4. The light fixture of claim 1, wherein the first elastomeric band has a thickness between 1 and 3 inches.

5. The light fixture of claim 1, further comprising a groove located radially around the outer surface of the light housing and which the first elastomeric band is positioned within.

6. The light fixture of claim 1, wherein the plurality of raised surfaces are configured to create gaps between the shroud and the light housing.

7. The light fixture of claim 1, further comprising a plurality of ridges elevated from an inner surface of the passage of the shroud and extending at least partially between the two openings of the passage.

8. The light fixture of claim 1, wherein the shroud is configured to be positioned around an outer surface of the light housing.

9. The light fixture of claim 1, wherein the shroud is configured to be positioned at least partially within an interior space within the light housing.

10. The light fixture of claim 1, wherein the plurality of vertically-extending surfaces have a uniform thickness along a vertical direction.

11. The light fixture of claim 1, wherein the plurality of vertically-extending raised surfaces comprises wave-like shapes, rounded ridges, or vertical grooves.

12. The light fixture of claim 1, further comprising a second elastomeric band disposed around the outside of the light housing; wherein the second elastomeric band has a plurality of vertically-extending raised surfaces projecting radially outward away from the light housing to create areas of increased and decreased thicknesses alternating circumferentially around the second elastomeric band.

13. A light fixture for outdoor installation, comprising:

a light housing having an elongated shape;

a lens located at a top of the light housing and configured to allow a light within the light housing to shine therethrough;

a removable shroud forming a passage with a first opening and a second opening therethrough; the first opening having a first shape and the second opening having a second shape; and, a first elastomeric band positioned between the light housing and the shroud; the first elastomeric band having a plurality of vertically-extending raised surfaces that have a uniform thickness along a vertical direction and that create areas of increased and decreased thicknesses circumferentially around the first elastomeric band so as to create a plurality of gaps between the removable shroud and the light housing;

wherein the shroud is configured to be positioned such that either the first opening or the second opening is positioned beyond the top of the light housing.

14. The light fixture of claim 13, wherein the first opening forms a perpendicular edge relative to a wall of the shroud, and wherein the second opening forms a non-perpendicular edge relative to the wall of the shroud.

15. The light fixture of claim 13, further comprising a plurality of longitudinal ridges extending between the first opening of the shroud and the second opening of the shroud, within a passage of the shroud.

16. The light fixture of claim 13, wherein the shroud is sized such that either the first opening or the second opening are positioned level with the top surface of the light housing.

17. The light fixture of claim 13, wherein the light housing further comprises a radially gap that is open at the top surface of the light housing and sized to accept the shroud at least partially within the gap.

18. The light fixture of claim 13, wherein the plurality of vertically-extending raised surfaces comprises wave-like shapes, rounded ridges, or vertical grooves.

19. The light fixture of claim 13, further comprising a second elastomeric band disposed around the outside of the light housing; wherein the second elastomeric band has a plurality of vertically-extending raised surfaces projecting radially outward away from the light housing to create areas of increased and decreased thicknesses circumferentially around the second elastomeric band.

20. A light fixture for outdoor installation, comprising:

a light housing configured to contain a light bulb;

a lens located at a top of the light housing and configured to allow the light bulb within the light housing to shine therethrough;

a shroud configured to mount on the light housing in a first orientation with a first end away from the light housing and in a second orientation with a second end away from the light housing; wherein the first end of the shroud has a first shape and the second end of the shroud has a second shape that is different than the first shape; and, a first elastomeric band positioned between the light housing and the shroud; the first elastomeric band having a plurality of vertically-extending drainage gaps located around an outer surface of the first elastomeric band, each gap extending between a top of the first elastomeric band and a bottom of the first elastomeric band and positioned between two vertically-extending raised surfaces; wherein the plurality of vertically-extending drainage gaps are configured to allow drainage between the shroud and the light housing.

* * * * *